US006861093B2

(12) United States Patent
Klutz et al.

(10) Patent No.: US 6,861,093 B2
(45) Date of Patent: Mar. 1, 2005

(54) WRINKLE-RESISTANT FABRICS HAVING DESIRABLE AESTHETIC CHARACTERISTICS, AND METHOD FOR MAKING SAME

(75) Inventors: David S. Klutz, Shelby, NC (US); Dale R. Williams, Greer, SC (US); David Osbon, Spartanburg, SC (US); Kimila C. Sasser, Cowpens, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/405,559

(22) Filed: Apr. 2, 2003

(65) Prior Publication Data

US 2003/0190430 A1 Oct. 9, 2003

Related U.S. Application Data

(62) Division of application No. 09/876,781, filed on Jun. 7, 2001.

(51) Int. Cl.[7] ..... B05D 1/34

(52) U.S. Cl. ..... 427/209; 427/211; 427/389.9; 427/392; 427/393.2

(58) Field of Search ..... 427/209, 211, 427/421, 428, 385.5, 389.9, 392, 394, 393.2, 396; 442/67, 66, 65, 102, 107, 286

(56) References Cited

U.S. PATENT DOCUMENTS

| | | | | |
|---|---|---|---|---|
| 2,988,457 A | | 6/1961 | Gatcomb | 442/67 |
| 3,634,126 A | * | 1/1972 | Cain et al. | 427/176 |
| 3,770,489 A | | 11/1973 | Richardson | 442/71 |
| 3,852,090 A | | 12/1974 | Leonard et al. | 442/63 |
| 3,968,146 A | * | 7/1976 | Lewis | 560/149 |
| 4,237,818 A | | 12/1980 | Clifford et al. | 118/410 |
| 4,269,602 A | * | 5/1981 | Worth et al. | 8/116.4 |
| 4,355,065 A | | 10/1982 | DeMott | 428/195 |
| 4,402,200 A | | 9/1983 | Clifford et al. | 68/200 |
| 4,562,097 A | | 12/1985 | Walter et al. | 427/209 |
| 4,655,056 A | | 4/1987 | Zeiffer | 68/205 R |
| 5,736,466 A | | 4/1998 | Wierer et al. | 442/67 |
| 6,372,674 B1 | | 4/2002 | Lack | 442/153 |

OTHER PUBLICATIONS

"Comparison Study of Polymer Research Finish to a Conventional Resin System: A Laundering Study", Cotton Incorporated, Research Report, Farias et al., Sep. 1996.

* cited by examiner

*Primary Examiner*—Katherine A. Bareford
(74) *Attorney, Agent, or Firm*—Terry T. Moyer; Sara M. Current

(57) ABSTRACT

A fabric having good wrinkle resistance and a soft hand is described. A process for producing the fabric is also described. The process involves applying a softener to one side of the fabric and applying a wrinkle-reducing resin to the opposite side of the fabric using a foaming application method, such that the respective finishes are concentrated on the surface to which they were applied. Preferably, the softener is applied to the face of the fabric and the resin chemistry is applied to the back of the fabric. The resulting fabrics have hand characteristics comparable or superior to those of pure finished fabrics, while having wrinkle-resisting characteristics of typical resin-treated fabrics.

20 Claims, 1 Drawing Sheet

WRINKLE-RESISTANT FABRICS HAVING DESIRABLE AESTHETIC CHARACTERISTICS, AND METHOD FOR MAKING SAME

This application is a Divisional of prior application Ser. No. 09/876.781 filed Jun. 7, 2001, now pending.

BACKGROUND

The invention is directed to a fabric having the hand characteristics of a pure finished product while having the wrinkle-resisting characteristics of a resin-treated product, and a method of making such fabrics. More specifically, the invention is directed to cellulosic fiber containing fabrics having desirable hand characteristics, strength and color in combination with good wrinkle-resisting characteristics.

In the production of textile fabrics, it is common for manufacturers to have to sacrifice certain product characteristics in order to achieve others. In other words, methods used to enhance one product characteristic often have a corresponding deleterious effect on another characteristic. Therefore, the end product often represents a compromise designed to provide the overall best balance of product characteristics.

In the case of fabrics designed to be used in the manufacture of apparel products, the achievement of a desirable balance of fabric properties can be extremely difficult, since many of the aesthetic characteristics are subjective and there are certain characteristics that must be maintained at particular levels to insure that a consumer will purchase the apparel. For example, flexibility, hand, color, and the like can be as important to the consumer as performance attributes such as strength and durability.

One area where this issue is particularly evident is in the manufacture of bottom-weight fabrics (i.e. those for use in the manufacture of pants.) Many conventional bottom-weight fabrics are made primarily or substantially entirely from cotton. While 100% cotton products are often favored from a "feel" and comfort standpoint, all-cotton products can have some disadvantages. For one, 100% cotton products are typically ring-dyed, and therefore often lose their color after only a minimal number of launderings and/or wearings. This is particularly notable along folded regions of the fabric. Second, the all-cotton fabrics tend to wrinkle undesirably, typically rendering ironing a necessity. In addition, the all-cotton fabrics do not tend to hold desirable creases, such as the crease often provided along the front of the legs on a pair of pants. Furthermore, the cotton fabrics can tend to lose a lot of strength following launderings and wearings.

To overcome the perceived disadvantage of cotton fabric wrinkling, durable (permanent) press finishes were introduced. Such finishes dramatically improve the wrinkle recovery of cotton fabrics, but these finishes can tend to make the fabric hand "harsh", and degrade the strength of the cotton fibers. To overcome some of the disadvantages of the durable-press all-cotton fabrics, some manufacturers blend the cotton fibers with stronger synthetic fibers such as polyester. While this tends to improve many of the performance characteristics, such as strength and color retention, the inclusion of the polyester can tend to decrease what is known as the desirable "cottony hand." In addition, because the polyester is hydrophobic, the fabrics often require the application of additional chemistry in order to achieve adequate moisture absorption characteristics.

There are several primary ways that cotton-containing bottom-weight fabrics are currently provided in the market.

The first is in what is known as a "pure finished" form, which means that the fabric has not been treated with a durable press resin-type treatment. Such fabrics have often been treated with a little softener, but offer essentially no wrinkle resistance or other performance characteristics.

The second form in which fabrics are currently produced is with a durable-press resin treatment. These fabrics are then typically provided to garment manufacturers in one of two forms. In the first, the resin is padded or otherwise applied to the fabric, and the resin is cured while the fabric is in its flat or open width state as part of the fabric finishing operation. These fabrics are known in the marketplace as "precured" fabrics. In the second form, the durable press resin treatment is at least somewhat unpolymerized when the fabric is provided to the garment manufacturer. (This can be performed by applying the resin treatment when the fabric is still in fabric form or after it has been formed into a garment.) Following construction of a garment from the fabric (and application of the resin treatment, if not previously applied), the fabric in the garment is finally cured, such as by wet fixation in a high-temperature wet bath, by a vapor-phase (steam) process, or by gamma radiation or low energy beta radiation treatments. These fabrics are typically referred to as "postcure" or delayed cure fabrics.

Typically, in the case of both precure and postcure fabrics, the garment manufacturer takes the garments and washes them a number of times, in order to reduce the harshness of hand that resulted from the resin treatment. Not only does this add significant expense to the manufacturing process, but the fabrics lose color and strength as a result.

Therefore, a need exists for a method for achieving wrinkle-resistant cellulosic fiber-containing fabrics which have the aesthetic characteristics of pure finished goods, with good color and strength.

SUMMARY

The present invention achieves a fabric having the desirable hand of a pure finished product, with the wrinkle resistance of a resin-treated fabric. Furthermore, the fabric has superior levels of strength and color at comparable levels of hand and feel of conventional washed and unwashed fabrics.

The process of the invention involves applying a durable press resin to one side of a fabric such that the resin is substantially isolated on the surface to which it is applied. A softener chemistry is applied to the opposite side of the fabric, preferably in a manner designed to isolate it on the surface to which it is applied. In a preferred process of the invention, the durable press resin and the softener are applied to the fabric substantially simultaneously, as this has been found to facilitate the isolation of the chemistries on their respective surfaces. In an alternative embodiment of the invention, the durable press resin is applied to a single side of the fabric, while softener chemistry is applied to both surfaces of the fabric.

In a preferred form of the invention, the chemistries are applied to their respective surfaces of the fabric by a foam application method, although other methods that achieve isolation of the chemistries can be used within the scope of the invention.

The fabrics of the invention desirably contain at least about 20% cellulosic fibers, and preferably at least about 65% to about 85% cellulosic fibers, such as cotton. The fabrics have been found to have the desirable aesthetic characteristics of a pure finished product, with the wrinkle resisting characteristics as good or better than those of conventional durable press resin-treated fabrics.

DETAILED DESCRIPTION

Figure 1:
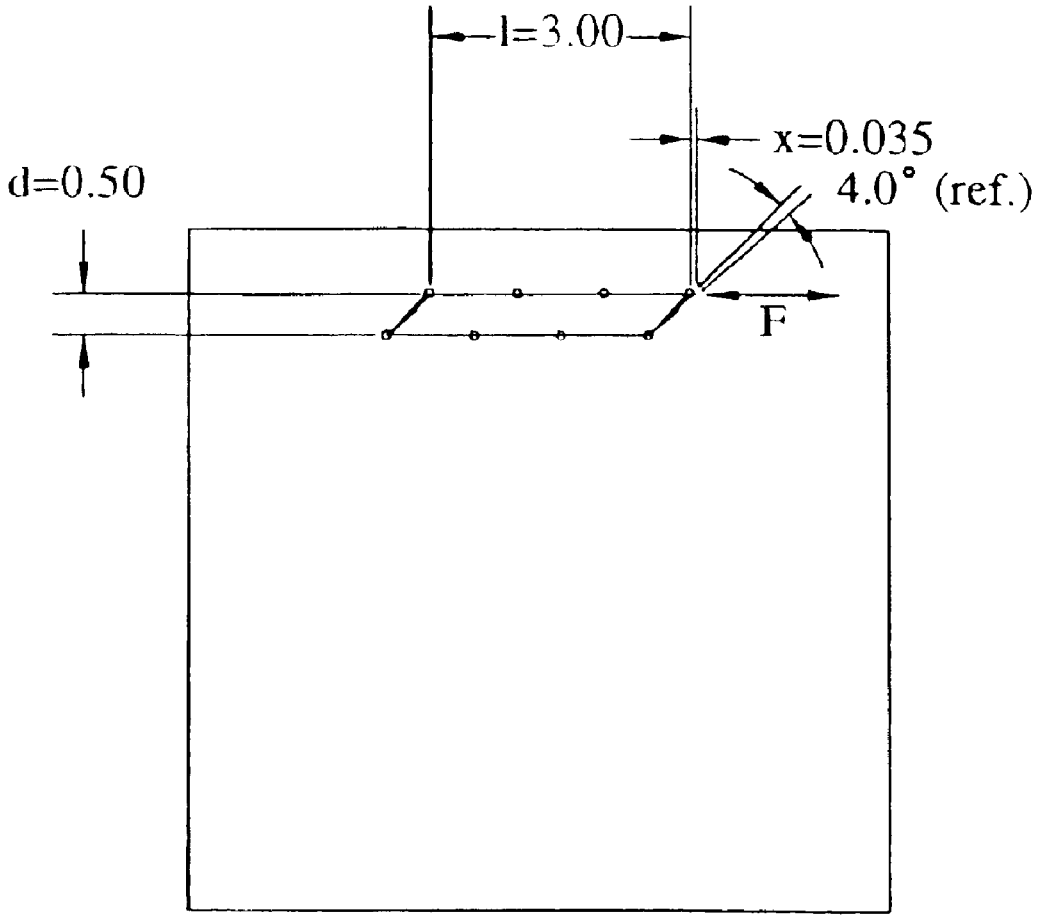
FIG. 1 is an illustration of the arrangement used to test fabric Drape.

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

The fabric of the invention is made by applying a softener (of the variety similar to that used in a traditional pure finish process) to a first face of a fabric and a durable press resin chemistry to the opposite face of the fabric, in a manner designed to isolate each of the chemistries on the respective fabric surfaces to which they were applied.

In a preferred form of the invention, the fabric is a cellulosic fiber-containing fabric, such as one containing cotton. Desirably, the fabric contains at least about 20%, and more preferably at least about 85% cellulosic fibers, and more preferably the fabric is made from substantially all cellulosic fibers such as all cotton. Where the fabric has less than all cellulosic fibers, it desirably includes synthetic fibers such as polyester, nylon, spandex, polylactide based fibers polytrimethylene terephthalase, or the like, or combinations thereof, in order to provide the fabric with additional strength and durability. For example, the fabric can be an 85/15 cotton/polyester blended fabric. Alternatively, the other component(s) could be some other type of natural fiber, including but not limited to linen, rayon and the like and combinations thereof with other natural and/or synthetic fibers.

The fabric can be constructed using any fabric formation technique, including but not limited to weaving, knitting or nonwoven fabric manufacturing processes, and can have any construction within those broad categories. For example, the process has been found to perform well on twill woven and plain woven fabrics. However, the process is equally applicable to fabrics made in other constructions and by other methods. Furthermore, the fabric can be of any weight and fiber content desired, using yarns formed by any yarn formation process. For example, the process of the invention has been found to perform well on bottom weight (e.g. about 4 to about 15 oz/sq yd, and preferably about 6 to about 9.5 oz/sq yd) fabrics made from all-cotton, open end spun yarns. However, other types of other yarns such as ring spun, air jet spun or vortex spun yarns could be used within the scope of the invention. For a top weight fabric (i.e. one to be used in the manufacture of garments for a wearer's upper torso), the fabrics will typically weigh from about 3 to about 8 oz/sq yd, although other weights could also be used.

The fabric is desirably prepared for processing in a conventional manner. For example, the fabric may be scoured to remove size, oils and the like which have accumulated as a result of the upstream processes, bleached and mercerized. The fabric may also be dried following the preparation process, if so desired The fabric may also be dyed if desired, to achieve a predetermined color, using any conventional dyeing process including but not limited to conventional continuous, semi-continuous, and discontinuous dye processes. Alternatively, the fabric can be produced from yarns which have already achieved the color desired, such as through a yarn dyeing process or the like.

The fabric can also be face finished if desired, such as by sanding or any other conventional face finishing process.

As noted above, the fabric has a softener chemistry applied to one of its faces, and a durable press resin chemistry applied to the other of its faces, with each of the chemistries being applied in a manner such that the chemistry is isolated on the respective face to which it is applied. For example, the chemistries can be applied by a foam application method, a spray method, a kiss roll, or any other method that can be used to isolate the chemistries on the respective surfaces to which they are applied. Preferably, a foam application method is used.

The chemistries are preferably applied to the fabric substantially simultaneously, as this assists in achieving isolation of the chemistries on their respective faces. A preferred application method involves the use of a foam application apparatus adapted for the substantially simultaneous application of foam chemistries to opposite fabric faces, such as the parabolic foam system marketed by Gaston Systems, Inc. equipped with two individual foam generators. For example, it has been found that applying the respective chemistries within a span of about 6 inches of each other onto a fabric moving at about 70 to about 120 yards per minute (ypm) achieves substantially simultaneous application of the chemistries and results in desirable chemistry isolation. Preferably the same method of application is used to provide the chemistry on each of the fabric surfaces, although a combination of different types of processes could be used within the scope of the invention.

In a preferred form of the invention, the face to which the softener is applied is the true "face" or "right side" of the fabric. In other words, it is the face of the fabric which will typically be used to form the outer, visible surface of a garment made from the fabric. This enables the wearer to achieve the maximum aesthetic benefits from the softened face of the fabric. In addition, since in this arrangement the durable press resin is applied to the back or "wrong" side of the fabric, any color loss experienced as a result of the resin treatment will be on the side of the fabric that will not be visible when the garment is worn.

The softener chemistry applied to one face of the fabric is preferably of a cationic amino functional polymer variety. However, other softeners such as cationic silicones, non-cationic silicones, fatty esters, and the like, and combinations thereof, could also be used, as could any other form of chemistry designed to improve the softness and hand of the fabric. The softener chemistry bath may also include such things as foaming agents, thickeners, and the like as desired to assist in the application of the chemistry as well as its isolation on its target surface. It has been found that by using a higher concentration (e.g. on the order of 2–5 times) the softener amount typically used in a pure finish, an unexpectedly superior hand was achieved. For example, a bath containing 6% silicone softener on weight of fabric (owf), 6% fatty amide softener owf and 3% polyethylene lubricant owf achieves good performance at about 20% wet pickup on a cotton fabric. For a cotton fabric in contrast, a normal pure finish typically might contain a mixture of 1.0% high density polyethylene owf, 0.175% wetting agents owf, and 0.56% fatty ester emulsion owf. It is also noted that other levels of application can be used as well as other chemical concentrations and formulations, and can be selected to achieve the desired characteristics for the particular fabric being processed. For example, wet pick up of about 10% to about 30% of the above described softener would be expected to achieve good results on an all cotton and cotton-blended bottom weight fabric substrates.

Similarly, the durable press resin chemistry applied to the other face of the fabric is preferably a glyoxal-based variety. However, other durable press resins and/or components such as dialdehydes (e.g. glyoxal and glutaraldehyde), dihydroxydimethylimidazolidinone ("DMUG"), divinyl sulfones, diepoxides, epichlorohydrin, polycarboxylic acids (e.g. butanetetracarboxylic acid or BTCA), polyaziridines (e.g. Trisaziridinyl phosphne oxide or APO), or phosphoric acid or polyphosphonic acids in combination with cyanamide and the like, and combinations thereof, could also be used, as could any other chemistry designed to improve the wrinkle resistance of the fabric. For example, a 9% durable press resin owf, 2% magnesium chloride catalyst mixture owf has been found to achieve good results on an all-cotton 6 to 9.5 oz/sq yd twill fabric.

The durable press resin also desirably includes other components such as foaming agents, thickeners and the like, in order to facilitate application of the durable press resin and isolation of it on its target surface. For example, foaming agents such as sodium lauryl sulfate could be included where the chemistry is to be applied by a foam application method. As with the softener, the level at which the chemistry is applied, the specific chemistry used and the application method used can be varied to achieve the desired results on the particular substrate used.

The fabric is then desirably dried in a conventional manner used for drying fabrics such as by running it through a tenter oven or other type of dryer. Alternatively, the fabric could be air dried if desired. If desired, the chemistries can also be cured at this time. Alternatively, the chemistries can be cured during a subsequent operation, either before or after they are transported to the customer. In this way, the fabrics can be provide to the customer in a pre or post cure form, depending on the preferences of the particular customer. As will be appreciated by those of ordinary skill in the art, the curing operation can comprise heating the fabric to a temperature sufficient to cross-link the chemistry to the fabric, or it can be performed by any other method that achieves cross-linking of the chemistry to the fabric.

EXAMPLES

A 3×1 lefthand twill 100% cotton fabric was woven using 16/1's open end spun yarns in the warp and 11/1's open end spun yarns in the filling. The fabric was cut into a number of pieces and used to form Samples A–F as described below.

Sample A: Sample A was prepared in a conventional manner used to prepare cotton fabrics for processing, using a desize, scour, and bleach. The fabric was mercerized, washed and dried in a conventional manner used to process 100% cotton fabrics. The fabric was then sanded in a conventional manner on a Succer-Muller five roll sander, as will be readily understood by those of ordinary skill in the art. The fabric was then dyed a khaki shade using a conventional continuous dye range used to dye 100% cellulosic fabrics. The dye formula included a mixture of yellow, brown and olive vat dyestuffs, and dried in a conventional manner known to produce khaki 100% cotton fabrics, as will be readily understood by those having ordinary skill in the art. The fabric was then pure finished in a conventional manner by padding on a mixture of 1.0% owf high density polyethylene, 0.175% owf wetting agent and 0.56% owf fatty ester emulsion. The fabric was then dried in a conventional manner to about 7–10% moisture content on a pin tenter finishing range at conventional temperatures used to process cotton fabrics, as will be readily appreciated by those of ordinary skill in the art. The fabric was than process on an industry standard compressive shrinkage apparatus (i.e. a Sanforizer) in a conventional manner, to impart shrinkage reduction characteristics to the fabrics.

Sample B was dyed a khaki color in the manner of Sample A, and processed as a traditional pre-cure fabric, meaning it was processed to have wrinkle resistant properties. More specifically, the fabric was dyed in the manner described above with respect to sample A, and the following finish chemistry was padded onto the fabric: 1.5% OWF High Density Polyethylene, 1.65% owf Magnesium Chloride Catalyst, 2.0% owf Cationic Softener, 2.0% owf Micro emulsion amino functional cationic polymer, 0.125% owf Wetting Agent, and 9.0% owf dimethyldihydroxyethylene urea ("DMDHEU"). The Sample B fabric was processed on a standard clip tenter finish range with known industry standard settings typically used to process 100% cotton fabrics (as will be readily understood by those of ordinary skill in the art), to allow the fabric to be first dried and then to "cure" or cross link the resin chemistry to achieve industry required performance characteristics. The fabric was then sanforized in a conventional manner.

Sample C was dyed a khaki color in the same manner as Samples A and B. A mixture of 6% owf micro emulsion amino functional cationic polymer, 6% owf cationic softener, 1.2% owf ethyxylated alcohol based foaming agent, and 3% owf high density polyethylene was applied at 20% wet pick up (wpu) by a foam application method onto the face of the fabric while a mixture of 9% owf DMDHEU, 2.04% owf magnesium chloride catalyst, and 0.36% owf amide oxide based foaming agent was applied substantially simultaneously at 12% wet pick up by a foam application method to the back of the fabric using a commercially available parabolic, dual sided foam applicator of the variety distributed by Gaston Systems, Inc. The fabric was processed through the foamer at 75 yards per minute as these two chemistries were applied. The foamer equipment was set for a main liquid flow rate of 3 to 7 liters per minute based on fabric weight and wet pick up, a blow ratio of 2 to 10, and a mixer speed of 1000 to 3000 rpm, and using half-inch slots for foam distribution, with the slots being spaced about 6 inches apart. The fabric was then processed through a finish range (which was in-line with the foam applicator) using temperatures and speeds of the variety used to dry and cure typical pre-cure fabrics. (e.g. in this case at a tenter temperature of about 360° F., and a curing oven temperature of about 380° F.). The fabric was then sanforized in a conventional manner.

Sample D was dyed a black color on a conventional dye range, with a mixture of black, navy and yellow reactive dyes. The fabric was then pure finished in the same manner as Sample A.

Sample E was dyed a black color in the same manner as Sample D, then pre-cure finished in the same manner as Sample B.

Sample F was dyed a black color in the same manner as Samples D and E, then softener chemistry was applied to the face of the fabric while a durable press resin chemistry was simultaneously applied to the back of the fabric in the manner described with respect to Sample C. The fabric was then dried, cured and sanforized in the manner described in Sample C.

Sample G was a commercially available 3×1 twill pre-cure fabric that had been dyed a khaki color. The warp was made of 16/1's open end spun yarns and the filling was made from 11/1's open end spun yarns. The fabric had a 114 ends per inch×45 picks per inch construction and weight of 8.05 oz/sq yd. The fabrid had been sanded and it is believed that the durable-press resin/softener had been applied to both faces of the fabric by a foam application process in a conventional manner.

Sample H was a commercially available 3×1 twill pre-cure sanded fabric that had been dyed a dark brown color. The warp was made of 16/1's open end spun yarns and the filling was made from 11/1's open end spun yarns, woven in a 115 ends per inch×46 picks per inch construction to form an 8.02 oz/sq yd fabric. It is believed that the durable-press resin/softener chemistries had been applied to both faces of the fabric by a foam application process in a conventional manner.

Sample I was a commercially available 3×1 twill that had been dyed black and precure finished. The warp was made from 16/1's ring spun yarns and the filling was made from 11/1's open end yarns. The fabric had 113 ends per inch×50 picks per inch to form an 8.44 oz/sq yd fabric. It is believed that the durable-press resin/softener chemistries had been applied to both faces of the fabric by a foam application process in a conventional manner.

Samples J, K and L were prepared as follows:

Sample J was a woven 3×1 left hand twill all cotton fabric having a weight of 7.75 oz/sq yd. The fabric had 20/1's ring spun yarns in the warp and 16/1's open end spun yarns in the filling, woven in a 126 ends per inch×64 picks per inch construction. The fabric was prepared, dyed, sanded and finished in the manner described above with respect to Sample C.

Sample K was a woven 3×1 left hand twill all cotton fabric having a weight of 8.0 oz/sq yd. The fabric had 20.5/1's combed ring spun yarns in the warp and 11/1 open end spun yarns in the filling, woven in a 125 ends per inch×53 picks per inch construction. The fabric was prepared, dyed, sanded and finished in the same manner as Sample C.

Sample L was a woven 3×1 left hand twill all cotton fabric having a weight of 8.0 oz/sq yd. The fabric had 20/1's ring spun yarns in the warp and 11/1 open end spun yarns in the filling, woven in a 118 ends per inch×54 picks per inch construction. The fabric was prepared, dyed, sanded and finished in the same manner as Sample C.

The following information was obtained for each of the fabrics using the following test methods.

Width: Width measurements were obtained according to ASTM-D3774-1996.

Construction: Fabric constructions were obtained according to ASTM D3775-1998.

Weight: Weights were obtained according to ASTM-D3776-1996, and presented in ounces per square yard.

Tensile strength: Tensile strengths were measured according to ASTM-D5034-1995. (Grab Test Method)

Tear strength: Tear strengths were measured according to ASTM-D1424-1996. (Trap Test Method)

Seam slippage: Seam slippages were measured according to ASTM-D434-1995, with "ss" indicating seam slippage and "sb" indicating seam break.

Pilling: Pilling was measured according to ASTM-D3512-1999a.

Appearance: Appearance was tested according to AATCC Test Method 124-1996.

Shrinkage: Fabric shrinkages were tested according to AATCC Test Method 135-1995.

Cuen: Cuen testing was performed to determine the degree of cross-linking between the resin finish and the cellulosic fibers on the finished fabrics. A warp yarn was removed from the fabric to be tested. The yarn was placed on a clean microscope slide. Using the edge of another microscope slide, the ends of the yarn were frayed. Only the frayed ends were left on the microscope slide. The frayed ends were covered with a microscope cover slip. The microscope slide was placed on the stage of a Projectina Projection Microscope, and the microscope was focused on the frayed ends where two or more cellulosic fibers could be observed. A timer was set at zero and readied for timing. One drop of CUEN (cupriethylenediamine) solution (at a concentration of 1.0 molar solution) was placed at the edge of the cover slip, and was observed through the microscope. When the CUEN solution reached the frayed ends, the timer was started. The fibers were watched and the results recorded based on Table A below, and times and ratings were recorded for each of the fabrics.

TABLE A

| Rating | Observation | Determination |
|---|---|---|
| 0 | Fiber dissolves immediately in CUEN solution | Uncured |
| 1 | Immediate, vigorous swelling of the fiber in less than 1 minute | Uncured |
| 2 | Fiber completely swells in 1 to 2 minutes | Uncured |
| 3 | Fiber completely swells in 2 to 3 minutes | Partial cure |
| 4 | Fiber completely swells in 3 to 4 minutes | Cured |
| 5 | Fiber completely swells in 4 to 5 minutes | Cured |
| 6 | Fiber completely swells in more than 5 minutes | Good cure |
| 7 | No swelling or motion of fibers | Well cured |

Abrasion resistance: Abrasion resistance was tested according to ASTM D3885-1999.

Drape: Drape (i.e. shear stiffness) was measured according to the following method using an Automatic Drape Tester. This test indicates the degree of stiffness of the fabric. An approximately 8¼ inch×8¼ inch sample of each of the fabrics was cut. Care was taken to ensure that the sample was cut no more than 5% bias. The sample was conditioned for a minimum of 4 hours according to ASTMD-1776-1998. The fabric is clamped on opposite sides using 3 inch clamps placed a half inch apart. The sample is then deflected 0.035 inches in the forward direction and then 0.035 inches in the backward direction. The force required in both the forward and backward direction is recorded. After each forward and backward deflection, the fabric is unclamped and rotated 90 degrees until all 4 sides are tested. A total of 8 force measurements are collected and averaged to obtain the shear stiffness (drape) using the equation below:

F=force applied to sample (grams)

L=length of clamps (inches)

D=distance between clamps (inches)

X=deflection distance (inches)

G=shear stiffness (grams/cm)

$$G=(FD/LX)(1/2.54)=[F(0.5)]/[(3.0)(0.035)(2.54)]=1.875F$$

The deflection and clamping of the fabric is illustrated in FIG. 1. All testing is performed on a single layer of fabric at standard conditions as described in ASTM D 1776-1998.

Washfastness: Washfastness (i.e. colorfastness to laundering) was tested according to AATCC Test Method 61-1996, 2A.

Crocking: Crocking (wet and dry) was tested according to AATCC Test Method 8-1996.

Frosting: Frosting (i.e. color change due to flat abrasion) was tested according to AATCC Test Method 119-99.

Air permeability: Air permeability was tested according to ASTM Test Method D737-96.

The results of the tests are listed below in Tables B–D. All fabrics were tested in their as-produced (i.e. "rigid") form unless otherwise specified.

TABLE B

| Sample | Width | Construction (warp ends per inch × filling ends per inch | Oz./ Sq. Yd. | Tensile Strength (warp × filling) | Tear Strength (warp × filling) |
|---|---|---|---|---|---|
| A | 64.58 | 116 × 52 | 8.54 | 152 × 86 | 3174 × 3462 |
| B | 65.13 | 117 × 48 | 8.3 | 125 × 58 | 2669 × 2512 |
| C | 64.63 | 117 × 48 | 8.45 | 122 × 53 | 2112 × 1766 |
| D | 64.38 | 117 × 49 | 8.86 | 138 × 75 | 2775 × 3244 |
| E | 65.5 | 114 × 54 | 8.52 | 115 × 54 | 2406 × 2522 |
| F | 64.63 | 115 × 49 | 8.86 | 126 × 58 | 1955 × 1686 |
| G | 65.63 | 114 × 45 | 8.05 | 98 × 44 | 2029 × 1846 |
| H | 65.75 | 115 × 46 | 8.02 | 112 × 45 | 2144 × 1898 |
| I | 63.75 | 113 × 50 | 8.44 | 149 × 75 | 2694 × 2387 |
| J | 66.00 | 130 × 59 | 7.50 | 133 × 45 | 2470 × 1178 |
| K | 65.88 | 124 × 51 | 7.92 | 127 × 51 | 2954 × 1834 |
| L | 65.88 | 116 × 51 | 7.34 | 106 × 52 | 2573 × 1853 |

TABLE C

| Sample | Seam Slippage (warp × filling) | Pilling | Flat-Dry Appearance | Shrinkage (warp × filling) | Cuen (warp × filling) |
|---|---|---|---|---|---|
| A | 30sb × 35sb | 4.5 | 1.5 | 1.2 × 1.6 | 0 × 0 |
| B | 32sb × 40 | 4.5 | 3.5 | 4.8 × 0.9 | 1 × 1 |
| C | 34sb × 40 | 4.5 | 4 | 4.6 × 0.5 | 1 × 1 |
| D | 32sb × 40 | 4.5 | 1 | 1.2 × 1.2 | 1.5 × 1.5 |
| E | 36sb × 38sb | 4.5 | 3.5 | 5.0 × 0.8 | 0 × 2 |
| F | 30sb × 40 | 4.5 | 4 | 4.4 × 0.6 | 1 × 4+ |
| G | 32ss × 34sb | 4.5 | 4 | 2.9 × 1.4 | 4 × 4 |
| H | 32ss × 38sb | 4.5 | 4 | 3.6 × 1.6 | 4 × 4 |
| I | 31sb × 38sb | 4.5 | 3.5 | 5.6 × 1.4 | 1 × 1 |
| J | 36ss × 39ss | 4.5 | 3.5 | 2.7 × 1.0 | — |
| K | 35ss × 40ss | 4.5 | 3.5 | 5.2 × 1.2 | — |
| L | 33ss × 35ss | 4.5 | 3.5 | 5.0 × 1.8 | — |

TABLE D

| Sample | Abrasion Resistance (warp × filling) | Drape | Wash-fastness (warp × filling) | Crock Dry × Wet | Frosting | Air Perm |
|---|---|---|---|---|---|---|
| A | 2000 × 2000 | 281 | 4 × 4 | 3.5 × 2.5 | 3.5 | 47.8 |
| B | 866 × 1084 | 207 | 4 × 4 | 3.5 × 2.0 | 3.5 | 45.9 |
| C | 1857 × 410 | 307 | 4 × 4 | 3.5 × 2.5 | 2.5 | 37.8 |
| D | 2000 × 2000 | 334 | 4 × 4 | 1.5 × 1.0 | 3.5 | 50.2 |
| E | 468 × 2000 | 249 | 4 × 4 | 2 × 1 | 3.5 | 39.9 |
| F | 1717 × 634 | 363 | 4 × 4 | 2 × 1 | 3.5 | 36.7 |
| G | 599 × 756 | 228 | 4 × 4 | 3.0 × 1.5 | 3.5 | 47 |
| H | 481 × 1219 | 301 | 4 × 4 | 4.0 × 2.5 | 3.5 | 40.7 |
| I | 1278 × 2000 | 417 | 4 × 4 | 3.0 × 1.5 | 3.5 | 28.6 |
| J | 1477 × 2470 | 190 | — | — | — | — |
| K | 1441 × 1282 | 209 | — | — | — | — |
| L | 560 × 1135 | 164 | — | — | — | — |

Samples of the fabrics A–F were then subjected to the following rinse and/or wash processes:

1) a 10 minute "top softener" process which involved a) for 5 minutes in a 1.5% owf amylaze based desize agent 140° F. at a liquor ratio of 10 to 1. The fabric was then washed (without chemicals) for 2 minutes at 100° F. at a pH of 5.0–7.0 and liquor ratio of 10 to 1. The liquid was then drained from the washer. The fabric is then softened for 10 minutes using 3% owf cationic softener, 3% owf amino functional cationic polymer and 16 grams buffer 5-0 at 90° F. using a 10 to 1 liquor ratio. (Note—a 9 lb. load in a 35 lb. Milnor Industrial washing machine can be used to achieve a liquor ratio of 10 to 1.) The fabric is then extracted and dried.
2) a 10 minute top softener in the manner described in part 1), followed by 5 home launderings according to AATCC standardization of Home Laundry Test Conditions (1995), Designation 3, available in the Manual of the American Association of Textile Chemists and Colorists.
3) 5 home launderings in the manner described with respect to part 2); and
4) subjected to 25 home washes.

The fabrics were then tested in a variety of forms (e.g. as produced or "rigid"), after top softening ("TS"), or after home launderings ("HW").

Kawabata Description

The fabrics were all tested to determine the following characteristics using the Kawabata Evaluation System ("Kawabata System"). The Kawabata System was developed by Dr. Sueo Kawabata, Professor of Polymer Chemistry at Kyoto University in Japan, as a scientific means to measure, in an objective and reproducible way, the "hand" of textile fabrics. This is achieved by measuring basic mechanical properties that have been correlated with aesthetic properties relating to hand (e.g. smoothness, fullness, stiffness, softness, flexibility, and crispness), using a set of four highly specialized measuring devices that were developed specifically for use with the Kawabata System. These devices are as follows:

Kawabata Tensile and Shear Tester (KES FB1)

Kawabata Pure Bending Tester (KES FB2)

Kawabata Compression Tester (KES FB3)

Kawabata Surface Tester (KES FB4)

KES FB1 through 3 are manufactured by the Kato Iron Works Col, Ltd., Div. Of Instrumentation, Kyoto, Japan. KES FB4 (Kawabata Surface Tester) is manufactured by the Kato Tekko Co., Ltd., Div. Of Instrumentation, Kyoto, Japan. In each case, the measurements were performed according to the standard Kawabata Test Procedures, with 4 8-inch×8-inch samples of each type of fabric being tested, and the results averaged. Care was taken to avoid folding, wrinkling, stressing, or otherwise handling the samples in a way that would deform the sample. The fabrics were tested in their as-manufactured form (i.e. they had not undergone subsequent launderings.) The die used to cut each sample was aligned with the yarns in the fabric to improve the accuracy of the measurements.

Shear Measurements

The testing equipment was set up according to the instructions in the Kawabata manual. The Kawabata shear tester (KES FB1) was allowed to warm up for at least 15 minutes before being calibrated. The tester was set up as follows:

Sensitivity: 2 and ×5

Sample width: 20 cm

Shear weight: 1.95 g

Tensile Rate: 0.2 mm/s

Elongation Sensitivity: 25 mm

The shear test measures the resistive forces when the fabric is given a constant tensile force and is subjected to a shear deformation in the direction perpendicular to the constant tensile force.

Mean Shear Stiffness (G) [gf/(cm-deg)]. A lower value for shear stiffness is indicative of a more supple hand.

Shear Hysteresis at 0.5°, 2.5° and 50°-(2HG05, 2HG25, and 2HG50, respectively) [gf/cm]—A lower value indicates that the fabric recovers more completely from shear deformation. This correlates to a more supple hand.

Residual Shear Angle at 0.5°, 2.5°, and 5.0° (RG05, RG25, and RG50, respectively.) [degrees] The lower the number, the more "return energy" required to return the fabric to its original orientation.

Four samples were taken in each of the warp and filling directions, averaged, and are listed below in Table E.

TABLE E

| Sample | Shear 2HG05 | Shear 2HG25 | Shear 2HG50 | Shear G | Shear RG05 | Shear RG25 | Shear RG50 |
|---|---|---|---|---|---|---|---|
| A | 4.435 | 7.36 | 10.603 | 2.61 | 1.698 | 2.819 | 4.061 |
| B | 3.696 | 5.485 | 7.816 | 2.045 | 1.807 | 2.692 | 3.827 |
| C | 4.449 | 8.308 | 12.369 | 3.504 | 1.268 | 2.372 | 3.54 |
| D | 4.733 | 7.725 | 10.864 | 2.923 | 1.623 | 2.645 | 3.792 |
| E | 4.35 | 6.696 | 9.576 | 2.457 | 1.766 | 2.723 | 3.902 |
| F | 4.915 | 8.715 | 12.605 | 3.795 | 1.286 | 2.296 | 3.333 |
| G | 3.319 | 5.256 | 8.284 | 2.107 | 1.573 | 2.496 | 3.944 |
| H | 3.387 | 4.914 | 7.303 | 1.796 | 1.883 | 2.734 | 4.07 |
| I | 5.787 | 10.373 | 15.505 | 3.636 | 1.591 | 2.854 | 4.271 |
| J | 2.1135 | 4.1895 | 7.1725 | 1.8465 | 1.1425 | 2.285 | 3.9015 |
| K | 2.561 | 4.4675 | 7.181 | 2.066 | 1.2375 | 2.1635 | 3.493 |
| L | 1.872 | 2.9745 | 5.0075 | 1.364 | 1.372 | 2.1815 | 3.6755 |
| A (after 5HW) | 8.575 | 13.284 | 15.258 | 3.878 | 2.214 | 3.427 | — |
| B (after 5HW) | 6.842 | 9.935 | 12.334 | 2.759 | 2.48 | 3.602 | — |
| C (after 5HW) | 5.651 | 8.468 | 11.449 | 2.497 | 2.261 | 3.389 | — |
| D (after 5HW) | 9.647 | 14.644 | 16.412 | 4.279 | 2.262 | 3.429 | — |
| E (after 5HW) | 7.494 | 10.799 | 12.872 | 3.039 | 2.47 | 3.557 | — |
| F (after 5HW) | 6.425 | 9.501 | 12.06 | 2.865 | 2.24 | 3.315 | — |
| G (after TS) | 4.382 | 5.843 | 7.604 | 1.873 | 2.337 | 3.119 | 4.064 |
| H (after TS) | 3.999 | 5.46 | 7.344 | 1.659 | 2.418 | 3.291 | 4.439 |
| I (after TS) | 3.874 | 5.299 | 6.956 | 2.046 | 1.8895 | 2.591 | 3.406 |

Surface Test

The testing equipment was set up according to the instructions in the Kawabata Manual. The Kawabata Surface Tester (KES FB4) was allowed to warm up for at least 15 minutes before being calibrated. The tester was set up as follows:

Sensitivity 1: 2 and ×5

Sensitivity 2: 2 and ×5

Tension Weight: 480 g

Surface Roughness Weight: 10 g

Sample Size: 20×20 cm

The surface test measures frictional properties and geometric roughness properties of the surface of the fabric.

Coefficient of Friction (MIU)—Mean coefficient of friction [dimensionless]. A lower coefficeient of friction indicates lower resistance and a smoother hand.

Surface Roughness (SMD)—Mean deviation of the displacement of contactor normal to surface [microns]. Indicative of the roughness of the fabric surface. High SMD values are associated with poor hand.

Mean Deviation of Coefficient of Friction (MMD) [dimensionless].

Four samples were taken in each of the warp and filling directions, averaged, and the results are listed below in Table F.

TABLE F

| Sample | MIU | MMD | SMD |
|---|---|---|---|
| A | 0.176 | 0.015 | 1.939 |
| B | 0.189 | 0.015 | 2.616 |
| C | 0.173 | 0.017 | 2.94 |
| D | 0.172 | 0.014 | 1.843 |
| E | 0.196 | 0.015 | 2.64 |
| F | 0.171 | 0.015 | 2.866 |
| G | 0.18 | 0.017 | 2.884 |
| H | 0.179 | 0.015 | 2.865 |

TABLE F-continued

| Sample | MIU | MMD | SMD |
|---|---|---|---|
| I | 0.212 | 0.019 | 2.676 |
| J | 0.1535 | 0.016 | 3.2055 |
| K | 0.14 | 0.031 | 3.1505 |
| L | 0.145 | 0.0155 | 3.857 |
| A (after 5HW) | 0.205 | 0.018 | 3.11 |
| B (after 5HW) | 0.212 | 0.017 | 3.059 |
| C (after 5HW) | 0.017 | 0.017 | 3.226 |
| D (after 5HW) | 0.018 | 0.018 | 3.142 |
| E (after 5HW) | 0.018 | 0.018 | 3.002 |
| F (after 5HW) | 0.016 | 0.016 | 3.351 |
| G (after TS) | 0.199 | 0.016 | 3.633 |
| H (after TS) | 0.206 | 0.016 | 3.594 |
| I (after TS) | 0.197 | 0.017 | 3.704 |

Bending

The testing equipment was set up according to the instructions in the Kawabata Manual. The Kawabata Bending Tester (KES FB2) was allowed to warm up for at least 15 minutes before being calibrated. The tester was set up as follows:

Sensitivity: 2 and ×1

Sample Size: 20×20 cm

The bending test measures the resistive force encountered when a piece of fabric that is held or anchored in a line parallel to the warp or filling is bent in an arc. The fabric is bent first in the direction of one side and then in the direction of the other side. This action produces a hysteresis curve since the resistive force is measured during bending and unbending in the direction of each side. The width of the fabric in the direction parallel to the bending axis affects the force. The test ultimately measures the bending momentum and bending curvature.

Bending Stiffness (B)—Mean bending stiffness per unit width [gf-cm$^2$/cm]. A higher mean bending stiffness indicates a more rigid fabric.

Mean width of bending hysteresis per unit width at K=0.05 cm$^{-1}$, 0.10 cm$^{-1}$, and 0.15 cm$^{-1}$ (2HB05, 2HB10, 2HB15, respectively) [gf-cm/cm] Lower value means the fabric recovers more completely from bending.

Residual bending curvature at K=0.05 cm$^{-1}$ (RBO5) [cm$^{-1}$] A lower number indicates a more rigid fabric. RB05 is inversely related to B.

Four samples were tested in each of the warp and filling directions, averaged, and the results are listed below in Table G.

Linearity of Compression—(LC)—Compares compression work with the work along a hypothetical straight line from ($X_0$, $y(X_0)$) to ($X_{max}$, $y(X_{max})$). The larger the value, the more linear the compression. This indicates that the fabric is more isotropic in behavior.

Compressional Resilience (RC) [%] A higher number indicates a more spongy fabric (i.e. it pushes back, indicating loft.)

Minimum Thickness—0.5 grams—(TMIN)—Thickness [mm] at minimum gf/cm$^2$).

Maximum Thickness (TMAX)—Thickness [mm] at maximum pressure (nominal is 50 gf/cm$^2$).

Total Thickness Change during Compression (TDIFF) [mm]—Difference of TMIN–TMAX. Indicates the total thickness change during compression.

TABLE G

| Sample | Bending 2HB05 | Bending 2HB10 | Bending 2HB15 | Bending B | Bending RB05 | Bending RB10 | Bending RB15 |
|---|---|---|---|---|---|---|---|
| A | 0.325 | 0.385 | 0.385 | 0.417 | 0.778 | 0.921 | 0.927 |
| B | 0.246 | 0.284 | 0.296 | 0.281 | 0.868 | 1 | 1.041 |
| C | 0.333 | 0.437 | 0.493 | 0.517 | 0.662 | 0.86 | 0.964 |
| D | 0.365 | 0.418 | 0.338 | 0.511 | 0.714 | 0.819 | 0.669 |
| E | 0.296 | 0.352 | 0.361 | 0.378 | 0.787 | 0.933 | 0.96 |
| F | 0.315 | 0.379 | 0.317 | 0.519 | 0.589 | 0.163 | 0.611 |
| G | 0.287 | 0.324 | 0.327 | 0.282 | 1.019 | 0.144 | 1.15 |
| H | 0.244 | 0.264 | 0.264 | 0.232 | 1.056 | 1.13 | 1.125 |
| I | 0.388 | 0.448 | 0.418 | 0.415 | 0.933 | 1.079 | 1.011 |
| J | — | — | — | — | — | — | — |
| K | — | — | — | — | — | — | — |
| L | — | — | — | — | — | — | — |
| A (after 5HW) | — | — | — | — | — | — | — |
| B (after 5HW) | — | — | — | — | — | — | — |
| C (after 5HW) | — | — | — | — | — | — | — |
| D (after 5HW) | — | — | — | — | — | — | — |
| E (after 5HW) | — | — | — | — | — | — | — |
| F (after 5HW) | — | — | — | — | — | — | — |
| G (after TS) | 0.274 | 0.287 | 0.281 | 0.219 | 1.241 | 1.286 | 1.253 |
| H (after TS) | 0.263 | 0.28 | 0.28 | 0.22 | 1.194 | 1.262 | 1.253 |
| I (after TS) | 0.278 | 0.297 | 0.296 | 0.249 | 1.119 | 1.189 | 1.181 |

Compression

The testing equipment was set up according to the instructions in the Kawabata manual. The Kawabata Compression Tester (KES FB3) was allowed to warm up for at least 15 minutes before being calibrated. The tester was set up as follows:

Sensitivity: 2 and ×5

Stroke: 5 mm

Compression Rate: 1 mm/50 s

Sample Size: 20×20 cm

The compression test measured the resistive forces experienced by a plunger having a certain surface area as it moves alternately toward and away from a fabric sample in a direction perpendicular to the fabric. The test ultimately measures the work done in compressing the fabric (forward direction) to a preset maximum force and the work done while decompressing the fabric (reverse direction).

% Compressibility—0.5 grams—(COMP) A larger value indicates the fabric has more loft.

Minimum Density—0.5 grams—(DMIN)—Fabric density at thickness TMIN[g/cm$^3$] A less dense fabric is usually more supple and soft.

Maximum Density—50 grams—(DMAX)—Fabric density at thickness TMAX[g/cm$^3$] A less dense fabric is usually more supple and soft.

Compressional Energy (WC)—Energy to compress fabric to 50 gf/cm$^2$[gf-cm/cm$^2$]. A higher number means that the fabric has more loft and is able to retain more loft during compression.

Decompressional Energy (WC')—This is an indication of the resilience of the fabric, with a larger number indicating greater resiliency.

Weight—[mg/cm$^3$]

Four samples were tested, averaged, and the results are listed below in Tables H and I.

TABLE H

| Sample | Comp | Den Max | Den Min | LC | Comp Res RC |
|---|---|---|---|---|---|
| A | 25.134 | 0.533 | 0.399 | 0.298 | 45.451 |
| B | 25.834 | 0.56 | 0.415 | 0.343 | 48.186 |
| C | 23.336 | 0.573 | 0.439 | 0.337 | 49.416 |
| D | 27.795 | 0.54 | 0.39 | 0.318 | 45.083 |
| E | 27.764 | 0.562 | 0.406 | 0.357 | 46.917 |
| F | 27.751 | 0.599 | 0.433 | 0.326 | 48.675 |
| G | 31.215 | 0.543 | 0.373 | 0.327 | 45.287 |
| H | 30.31 | 0.54 | 0.376 | 0.321 | 43.528 |
| I | 32.632 | 0.559 | 0.376 | 0.308 | 43.156 |
| J | 30.957 | 0.587 | 0.405 | 0.272 | 50.428 |
| K | 29.863 | 0.401 | 0.401 | 0.287 | 50.664 |

TABLE H-continued

| Sample | Comp | Den Max | Den Min | LC | Comp Res RC |
|---|---|---|---|---|---|
| L | 32.338 | 0.371 | 0.371 | 0.281 | 51.357 |
| A (after 5HW) | 30.72 | 0.423 | 0.293 | 0.357 | 35.546 |
| B (after 5HW) | 34.321 | 0.434 | 0.285 | 0.398 | 36.025 |
| C (after 5HW) | 33.438 | 0.451 | 0.3 | 0.395 | 35.83 |
| D (after 5HW) | 34.89 | 0.42 | 0.274 | 0.358 | 33.326 |
| E (after 5HW) | 35.243 | 0.43 | 0.278 | 0.408 | 32.982 |
| F (after 5HW) | 31.181 | 0.46 | 0.316 | 0.42 | 37.753 |
| G (after TS) | 40.989 | 0.451 | 0.266 | 0.365 | 38.698 |
| H (after TS) | 42.16 | 0.448 | 0.259 | 0.359 | 38.304 |
| I (after TS) | 43.076 | 0.457 | 0.261 | 0.375 | 39.61 |

TABLE I

| Sample | Comp TDIFF | Comp TMAX | Comp TMIN | Comp WC | Comp WC Prime | Comp Wt |
|---|---|---|---|---|---|---|
| A | 0.194 | 0.575 | 0.768 | 0.146 | 0.066 | 30.6 |
| B | 0.189 | 0.542 | 0.73 | 0.163 | 0.079 | 30.306 |
| C | 0.16 | 0.525 | 0.685 | 0.134 | 0.066 | 30.1 |
| D | 0.225 | 0.584 | 0.809 | 0.177 | 0.08 | 31.506 |
| E | 0.213 | 0.555 | 0.767 | 0.188 | 0.088 | 31.158 |
| F | 0.206 | 0.535 | 0.74 | 0.167 | 0.081 | 32.056 |
| G | 0.245 | 0.538 | 0.783 | 0.199 | 0.09 | 29.219 |
| H | 0.24 | 0.552 | 0.792 | 0.192 | 0.083 | 29.769 |
| I | 0.264 | 0.543 | 0.806 | 0.203 | 0.088 | 30.313 |
| J | 0.194 | 0.433 | 0.627 | 0.134 | 0.067 | 25.4 |
| K | 0.204 | 0.478 | 0.682 | 0.146 | 0.074 | 27.294 |
| L | 0.221 | 0.462 | 0.682 | 0.155 | 0.08 | 25.294 |
| A (after 5HW) | .0318 | 0.717 | 1.035 | 0.283 | 0.1 | 30.317 |
| B (after 5HW) | 0.355 | 0.679 | 1.034 | 0.351 | 0.126 | 29.458 |
| C (after 5HW) | 0.325 | 0.647 | 0.972 | 0.318 | 0.114 | 29.175 |
| D (after 5HW) | 0.392 | 0.732 | 1.124 | 0.352 | 0.117 | 30.578 |
| E (after 5HW) | 0.383 | 0.703 | 1.085 | 0.39 | 0.129 | 30.192 |
| F (after 5HW) | 0.3 | 0.663 | 0.963 | 0.315 | 0.119 | 30.475 |
| G (after TS) | 0.43 | 0.618 | 1.047 | 0.391 | 0.152 | 27.869 |
| H (after TS) | 0.439 | 0.602 | 1.041 | 0.393 | 1.151 | 26.944 |
| I (after TS) | 0.49 | 0.646 | 1.136 | 0.458 | 0.181 | 29.531 |

Tensile

The tensile test measures the tensile strain (force) when a fabric sample of a certain length is held by two chucks and when the chucks move apart. The length is perpendicular to the direction of motion. The test ultimately measures how much the fabric can be extended by a preset (500 gf/cm) amount of tensile force and measures several quantities related to the work required to extend the fabric.

% strain (extension) at 500 gf/cm (EMT) [percent]—This is an indication of the extensibility of the fabric (i.e. the ability to stretch and then retain its shape.)

Linearity of Tensile (LT)—Compares extension work with the work along a hypothetical straight line from (0, 7(0)) to (X max, y (Xmax)) [dimensionless].

Tensile work (energy) during extension (WT) [gf/cm]—Indicates the energy required during extension.

Tensile resiliency (RT) [percent]. Indicates the percent resiliency.

Four samples were tested in each of the warp and filling directions, averaged, and the results are listed below in Table J.

TABLE J

| Sample | Tensile EMT | Tensile LT | Tensile RT | Tensile WT |
|---|---|---|---|---|
| A | 6.719 | 0.805 | 42.691 | 13.593 |
| B | 4.593 | 0.739 | 50.736 | 8.844 |

TABLE J-continued

| Sample | Tensile EMT | Tensile LT | Tensile RT | Tensile WT |
|---|---|---|---|---|
| C | 3.653 | 0.83 | 48.699 | 7.944 |
| D | 6.436 | 0.818 | 43.948 | 13.153 |
| E | 4.173 | 0.789 | 49.843 | 8.608 |
| F | 3.793 | 0.843 | 50.505 | 8.401 |
| G | 3.839 | 0.748 | 51.446 | 7.34 |
| H | 4.356 | 0.705 | 52.999 | 7.923 |
| I | 3.974 | 0.854 | 42.638 | 8.727 |
| J | — | — | — | — |
| K | — | — | — | — |
| L | — | — | — | — |
| A (after 5HW) | — | — | — | — |
| B (after 5HW) | — | — | — | — |
| C (after 5HW) | — | — | — | — |
| D (after 5HW) | — | — | — | — |
| E (after 5HW) | — | — | — | — |
| F (after 5HW) | — | — | — | — |
| G (after TS) | 5.898 | 0.611 | 51.593 | 9.161 |
| H (after TS) | 5.436 | 0.627 | 50.279 | 8.6 |
| I (after TS) | 6.71 | 0.634 | 47.233 | 10.741 |

Each of the fabrics was then tested for tensile and tear strength, as well as drape (according to the previously-described test methods.) The results after the 10 minute top softener are listed below in Table K, Table L shows the results after the 10 minute top softener and 5 home launderings, Table M shows the results after 5 home launderings, and Table N shows the results after 25 home launderings.

TABLE K

10 Top Soften (10 minute TS)

| Sample | Tensile (warp × fill) | Tear (warp × fill) | Drape Value |
|---|---|---|---|
| A | 133 × 80 | 3174 × 3610 | 240 |
| B | 126 × 61 | 2774 × 2806 | 216 |
| C | 112 × 54 | 2208 × 1898 | 232 |
| D | 132 × 77 | 3001 × 3290 | 266 |
| E | 114 × 69 | 2413 × 2842 | 238 |
| F | 118 × 57 | 2189 × 1971 | 257 |

TABLE L

10 Minute Top Soften plus 5 Home Launderings (10 min TS + 5 HW)

| Sample | Tensile (warp × fill) | Tear (warp × fill) | Drape (value) |
|---|---|---|---|
| A | 171 × 120 | 1824 × 1875 | 386 |
| B | 132 × 77 | 2342 × 2704 | 259 |
| C | 130 × 63 | 1949 × 1789 | 232 |
| D | 158 × 109 | 2074 × 2355 | 436 |
| E | 126 × 86 | 1926 × 2816 | 285 |
| F | 130 × 63 | 1926 × 1914 | 250 |

TABLE M

5 Home Launderings (5HW)

| Sample | Tensile (warp × fill) | Tear (warp × fill) | Drape Value |
|---|---|---|---|
| A | 172 × 121 | 1766 × 1833 | 426 |
| B | 236 × 78 | 2435 × 2656 | 279 |
| C | 117 × 63 | 1885 × 1744 | 242 |
| D | 146 × 101 | 1869 × 1869 | 481 |

TABLE M-continued

| 5 Home Launderings (5HW) | | | |
|---|---|---|---|
| Sample | Tensile (warp × fill) | Tear (warp × fill) | Drape Value |
| E | 133 × 87 | 2189 × 2771 | 335 |
| F | 135 × 62 | 1926 × 1856 | 272 |

TABLE N

| 25 Home Launderings (25 HW) | | | |
|---|---|---|---|
| Sample | Tensile (warp × fill) | Tear (warp × fill) | Drape Value |
| A | 165 × 123 | 1709 × 1760 | 331 |
| B | 139 × 89 | 1811 × 2245 | 311 |
| C | 125 × 69 | 1395 × 1261 | 260 |
| D | 148 × 112 | 1632 × 1779 | 444 |
| E | 134 × 85 | 1677 × 2246 | 336 |
| F | 119 × 72 | 1664 × 1606 | 287 |

As illustrated, the fabrics of the invention have wrinkle resisting characteristics of a resin-treated fabric, with aesthetic characteristics more like those of a pure finished product. In addition, the aesthetic characteristics of the fabrics of the invention were surprisingly found to improve with a number of washings, whereas typical resin-treated fabrics generally become harsher after a number of washings, as softener typically comes off with washing, rendering the less desirable harsh hand of the resin more dominant. This surprising characteristic is evidenced by the lower drape values achieved by the instant invention for the fabrics of the present invention.

The fabrics made according to the instant invention are particularly useful in the manufacture of all types of apparel, including but not limited to shirts, pants, jackets, skirts, dresses, hats, scarves, etc. The fabrics would also be useful in any other end use where fabrics having good aesthetic characteristics in combination with wrinkle resistance would be desirable.

In the specification there has been set forth a preferred embodiment of the invention, and although specific terms are employed, they are used in a generic and descriptive sense only and not for purpose of limitation, the scope of the invention being defined in the claims.

We claim:

1. A process for finishing a fabric comprising the steps of:

applying a softener to one face of a fabric such that the softener is substantially isolated on the face to which it is applied; and applying a durable press resin to the opposite face of the fabric such that the resin is substantially isolated on the face to which it is applied, wherein said steps of applying a softener to one face of the fabric and a durable press resin to the opposite face of the fabric are performed substantially simultaneously, and drying the fabric, to thereby form a fabric having good durable press and hand characteristics.

2. The process according to claim 1, wherein said fabric comprises cellulosic fibers.

3. The process according to claim 2, wherein said fabric comprises at least 50% cellulosic fibers.

4. The process according to claim 2, wherein said fabric comprises at least 65% cellulosic fibers.

5. The process according to claim 2, wherein said fabric comprises at least 85% cellulosic fibers.

6. The process according to claim 2, wherein said fabric comprises substantially all cellulosic fibers.

7. The process according to claim 1, wherein said step of applying a softener to one side of the fabric is performed by a foam application method.

8. The process according to claim 1, wherein said step of applying a softener to one face of the fabric is performed by a method selected from the group consisting of foam application, spraying, and kiss roll application.

9. The process according to claim 1, wherein said step of applying a durable press resin to the opposite face of the fabric is performed by a method selected from the group consisting of foam application, spraying, and kiss roll application.

10. The process according to claim 1, wherein said steps of applying a softener to one face and a durable press resin to the opposite face of the fabric are performed by a foam application method.

11. The process according to claim 1, wherein said step of applying a durable press resin to the opposite face of the fabric is performed on the fabric back.

12. The process according to claim 1, further comprising the step of curing the durable press resin.

13. The process according to claim 12, wherein said step of curing is performed at substantially the same time as said step of drying.

14. The process according to claim 1, further comprising the step of face finishing the fabric prior to applying the softener and durable press resin.

15. A process for finishing a cellulosic-fiber containing fabric comprising the steps of:

applying a softener to the face of a cellulosic fiber-containing fabric by a foam application method such that the softener is substantially isolated on the face of the fabric; and applying a durable press resin to the back of said fabric by a foam application method such that the resin is substantially isolated on the fabric back, wherein said steps of applying a softener to one face of the fabric and a durable press resin to the opposite face of the fabric are performed substantially simultaneously; and drying the fabric, to thereby form a fabric having good durable press and hand characteristics.

16. A process according to claim 15, wherein said cellulosic fiber-containing fabric comprises at least about 50% cellulosic fibers.

17. A process according to claim 16, wherein said cellulosic fiber-containing fabric comprises at least about 65% cellulosic fibers.

18. A process according to claim 16, wherein said cellulosic fiber-containing fabric comprises at least about 85% cellulosic fibers.

19. A process according to claim 16, wherein said cellulosic fiber-containing fabric comprises substantially all cellulosic fibers.

20. A process according to claim 19, wherein said steps of applying a softener, applying a durable press resin and drying the fabric are performed to achieve a fabric having an Appearance Rating of at least about 4.0 and a Drape Value of at least about 307.

* * * * *